US005980146A

United States Patent [19]

To

[11] Patent Number: 5,980,146

[45] Date of Patent: *Nov. 9, 1999

[54] RING BINDER

[75] Inventor: Simon Chun Yuen To, Kowloon, The Hong Kong Special Administrative Region of the People's Republic of China

[73] Assignee: World Wide Stationery Manufacturing Company, Ltd., The Hong Kong Special Administrative Region of the People's Republic of China

[ * ] Notice: This patent issued on a continued prosecution application filed under 37 CFR 1.53(d), and is subject to the twenty year patent term provisions of 35 U.S.C. 154(a)(2).

[21] Appl. No.: 08/546,021

[22] Filed: Oct. 20, 1995

[51] Int. Cl.[6] ..... B42F 13/00

[52] U.S. Cl. ..... 402/26; 402/36; 402/31

[58] Field of Search ..... 402/26, 36, 31, 402/38, 37, 42, 41

[56] References Cited

U.S. PATENT DOCUMENTS

| | | | |
|---|---|---|---|
| 813,753 | 2/1906 | Trussell | 402/31 |
| 1,494,626 | 5/1924 | Pitt | 402/36 |
| 1,813,599 | 7/1931 | Adams . | |
| 1,816,021 | 7/1931 | Meyerson | 402/36 |
| 1,932,874 | 10/1933 | Adams et al. . | |
| 2,325,155 | 7/1943 | Wedge | 402/38 |
| 2,447,963 | 8/1948 | Segal . | |
| 2,552,076 | 5/1951 | Wedge | 281/19 |
| 5,476,335 | 12/1995 | Whaley | 402/26 |

FOREIGN PATENT DOCUMENTS

| | | |
|---|---|---|
| 1211335 | 9/1986 | Canada . |
| 0188679 | 7/1986 | European Pat. Off. . |
| 2 209 500 | 5/1989 | United Kingdom . |

*Primary Examiner*—Willmon Fridie, Jr.
*Attorney, Agent, or Firm*—Hall, Priddy & Myers

[57] ABSTRACT

A ring binder (100, 200) adapted to be secured to a cover (116, 214) is disclosed as comprising a substantially rigid upper plate member (102, 202) supporting a pair of lower pivotable plates (104*a*, 104*b*, 204*a*, 204*b*) to which a plurality of rings (106, 206) are mounted, and the upper plate member (102, 202) comprises two ends and the cover (116, 214) abuts at least part of the upper plate member (102, 202), and said part surrounds the end of the upper plate member (102, 202) by substantially 360°.

25 Claims, 8 Drawing Sheets

RING BINDER

FIELD OF THE INVENTION

This invention relates to a ring binder, and in particular a ring binder adapted to be secured by at least one engagement means to a cover.

BACKGROUND OF THE INVENTION

Conventionally, a ring binder is securable to a cover by at least one rivet having a head portion for engagement with the cover and a tail portion which is deformable to engage a recess in the upper part of the ring binder.

A disadvantage associated with such an arrangement is that the ring binder may wobble relative to the cover such that the connection(s) therebetween may be loosened.

It is therefore an object of the present invention to provide a ring binder in which the aforesaid shortcoming is mitigated.

SUMMARY OF THE INVENTION

According to a first aspect of the present invention, there is provided a ring binder adapted to be secured to a base member, which ring binder comprises a substantially rigid upper structure supporting a pivotable lower structure to which a plurality of ring members are mounted characterized in that the upper structure comprises two ends, each of which includes at least one securing means and wherein the part where the securing means joins the upper structure is substantially surrounded.

According to a second aspect of the present invention, there is provided a ring binder adapted to be secured to a base member, which ring binder comprises a substantially rigid upper structure supporting a pivotable lower structure to which a plurality of ring members are mounted characterized in that at least part of the upper structure on both sides of the longitudinal axis of the ring binder near, at or adjacent the extremities of the upper structure is adapted to abut the base member.

BRIEF DESCRIPTION OF THE DRAWINGS

The invention will now be described by way of example with reference to the accompanying drawings, in which.

DETAILED DESCRIPTION

Figure 1:
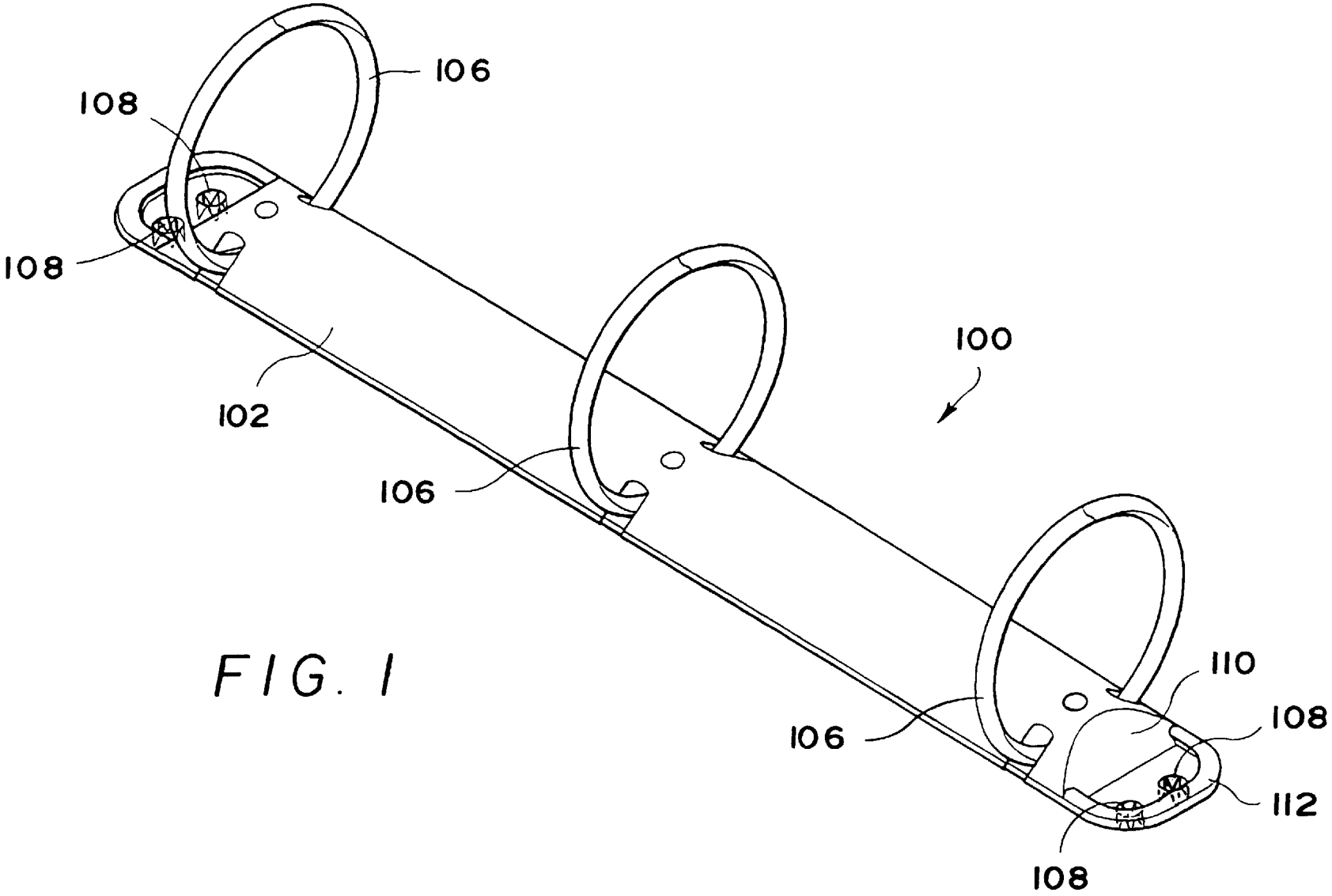
FIG. 1 shows a top perspective view of a first embodiment of a ring binder according to the present invention.
Figure 2:
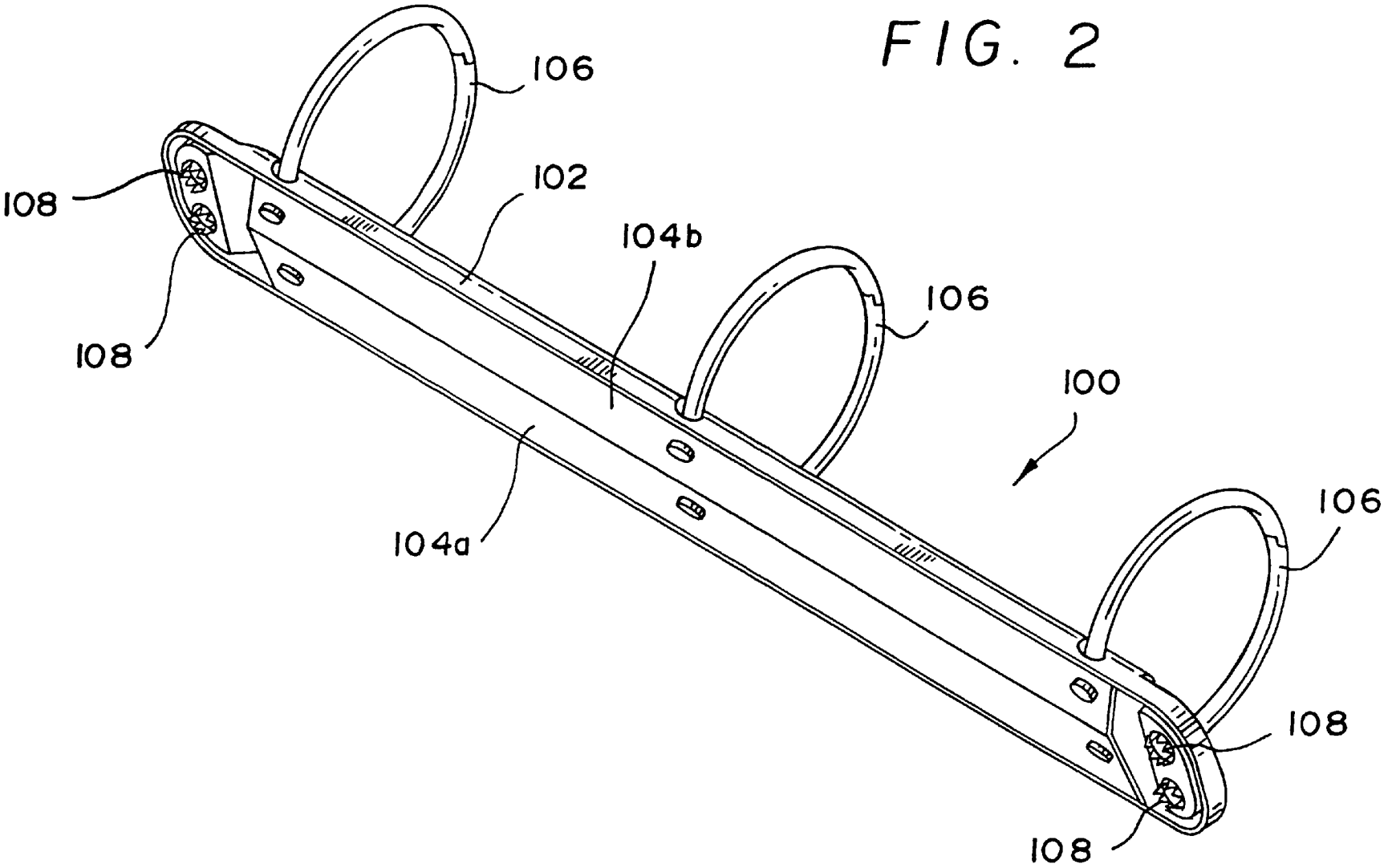
FIG. 2 shows a bottom perspective view of the ring binder shown in FIG. 1.
Figure 3:
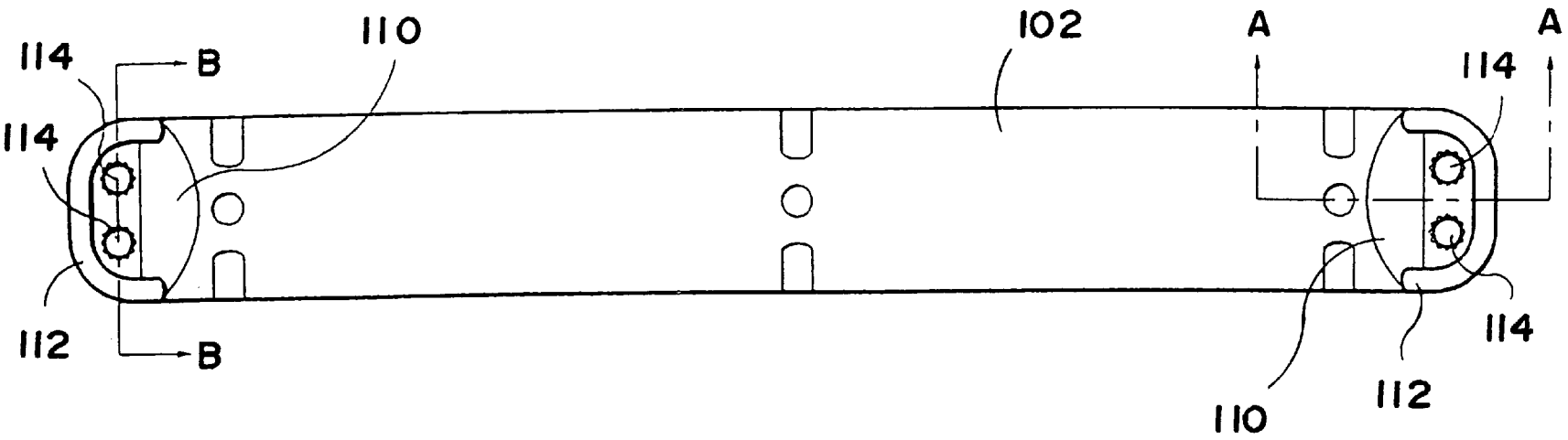
FIG. 3 shows a top view of the ring binder shown in FIG. 1 with rings removed.
Figure 4:
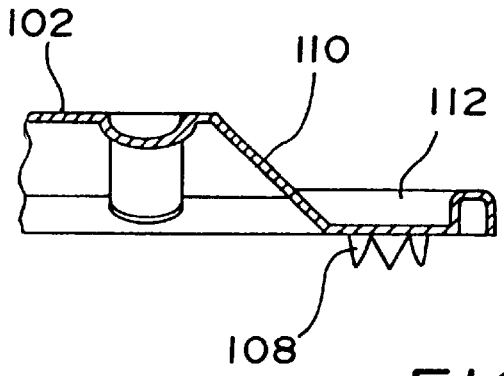
FIG. 4 shows a sectional view along the line A—A of the ring binder shown in FIG. 3.
Figure 5:
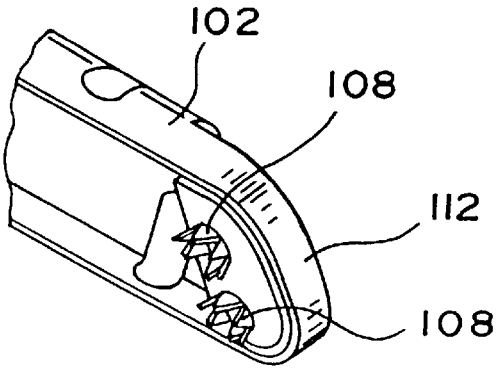
FIG. 5 shows a partial bottom perspective view of the upper structure of the ring binder shown in FIG. 1.
Figure 6:
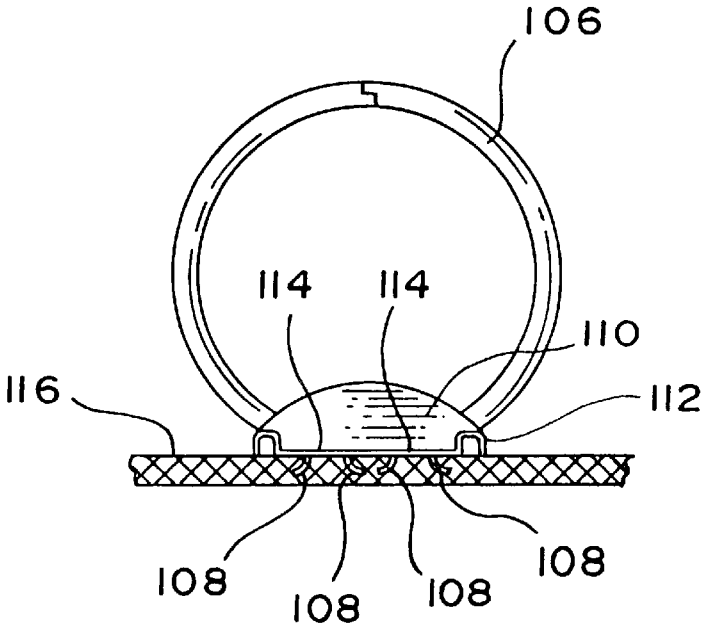
FIG. 6 shows a sectional view along the line B—B of the ring binder shown in FIG. 3 with rings and as secured to a cover.

FIGS. 1 and 2 show a first embodiment of a ring binder according to the present invention generally designated as 100. The ring binder 100 includes a substantially rigid upper plate member 102 supporting a pair of lower plates 104*a* and 104*b*. The lower plates 104*a* and 104*b* are pivotally movable relative to each other to enable rings 106 to be selectively opened or closed in the conventional manner. At each end of the upper plate member 102 are two sets of claws 108. Around each pair of sets of claws 108 are a slanted slope 110 and an outer ridge 112. Both the slanted slope 110 and outer ridge 112 are formed integrally with the upper plate member 102.

As shown more clearly in FIGS. 3 to 6, each set of claws 108 are arranged along the periphery of a hole 114. When the ring binder 100 is secured to, e.g, a cardboard cover 116 (see FIG. 6), the claws 108 are pressed into the cover 116 and splayed out to strengthen the connection between the ring binder 100 and the cover 116. As shown clearly in FIG. 6, the outer edges of the outer ridge 112 abut the cover 116 on both sides. Such an arrangement assists in minimizing any wobbling action that may occur between the ring binder 100 and the cover 116.

Figure 7:
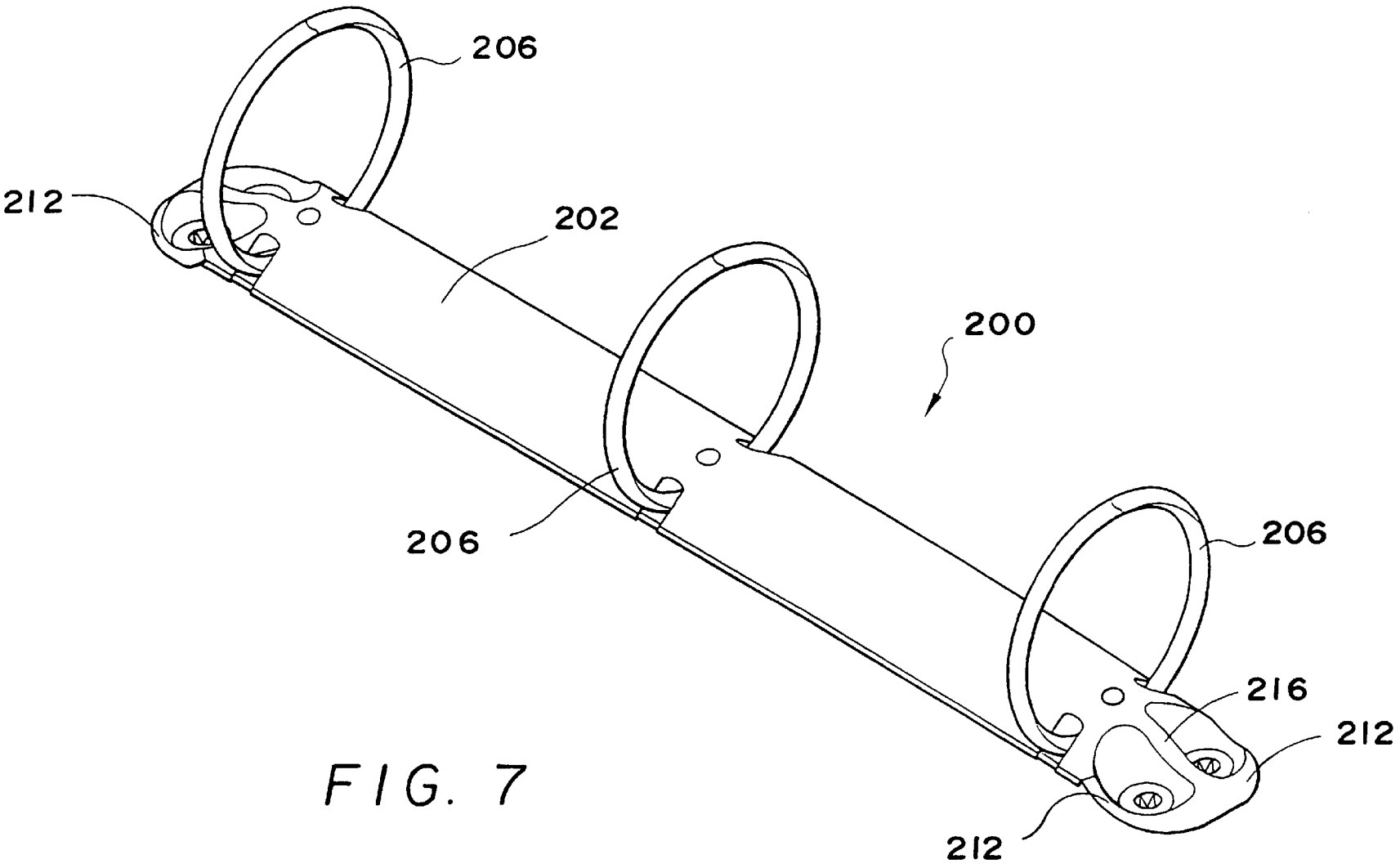
FIG. 7 shows a top perspective view of a second embodiment of a ring binder according to the present invention.
Figure 8:
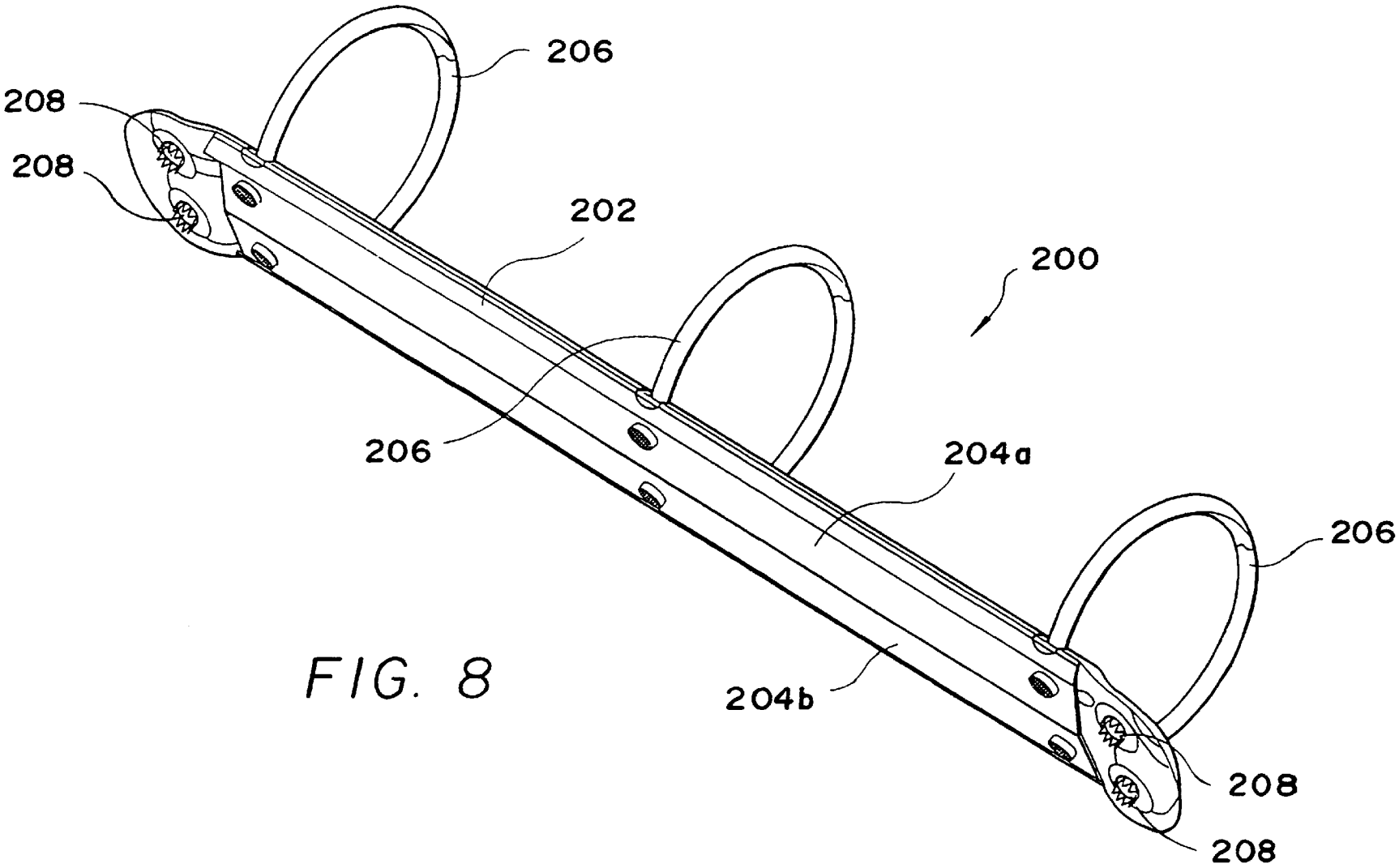
FIG. 8 shows a bottom perspective view of the ring binder shown in FIG. 7.

FIGS. 7 and 8 show a second embodiment of a ring binder according to the present invention generally designated as 200. Similar to the first embodiment described above, the ring binder 200 includes a substantially rigid upper plate member 202 supporting a pair of lower plates 204*a* and 204*b*. The lower plates 204*a* and 204*b* are pivotally movable relative to each other to enable rings 206 to be selectively opened or closed in the conventional manner. At each end of the upper plate member 202 are two sets of claws 208.

Figure 9:
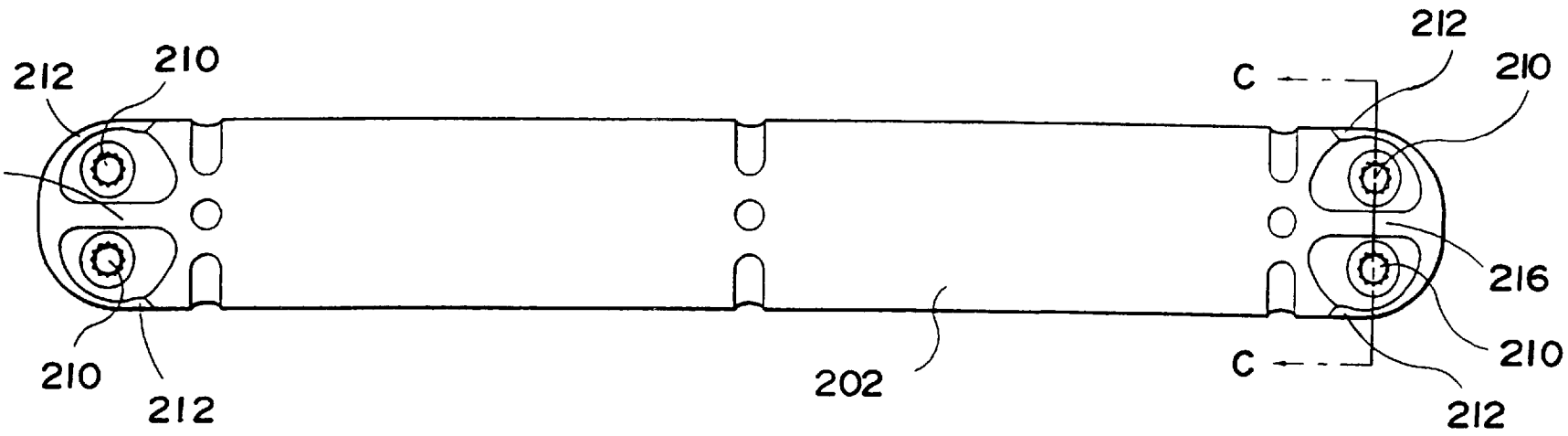
FIG. 9 shows a top view of the ring binder shown in FIG. 7.
Figure 10:
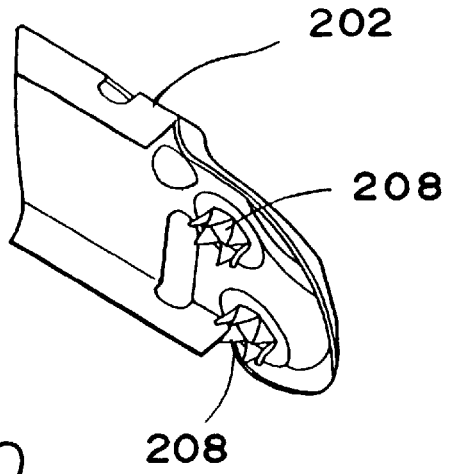
FIG. 10 shows a partial bottom perspective view of the upper structure of the ring binder shown in FIG. 7.
Figure 11:
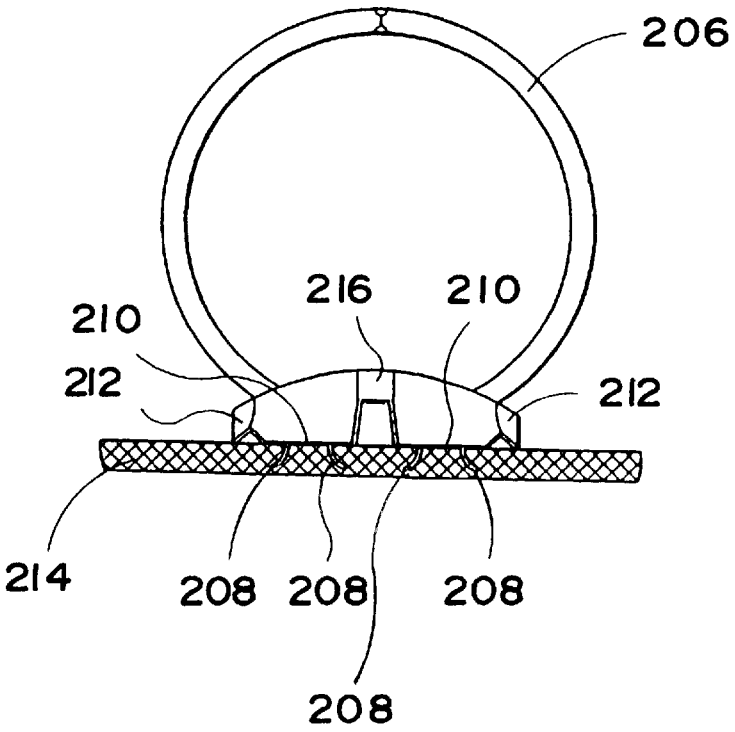
FIG. 11 shows a sectional view along the line C—C of the ring binder shown in FIG. 9 with rings and as secured to a cover.

As can be seen more clearly in FIGS. 9 to 11, each set of claws 208 depend from the periphery of a hole 210 surrounded by an outer ridge 212 on all sides. When assembling the ring binder 200 to, e.g., a cardboard cover 214, the claws 208 are pressed into the cover 214. This action causes the claws 208 to be splayed out and thereby to enhance the connection between the ring binder 200 and the cover 214. As in the case of the first embodiment discussed above, the outer edges of the outer ridge 212 abut the cover 214 on both sides. In addition, the two sets of claws 208 are separated by a wall 216 integrally formed with the upper plate member 202. This wall 216 also assists, in addition to the outer ridges 212, in minimizing any wobbling action that may occur between the ring binder 200 and the cover 214.

It should be understood that the above only illustrates by way of examples embodiments in which the present invention may be carried out. Further modifications and/or improvements may be made without departing from the spirit of the invention.

I claim:

1. A ring binder adapted to be secured to a base member, which ring binder comprises:

a substantially rigid upper structure supporting a pivotable lower structure to which a plurality of ring members are mounted, the upper structure having two ends, each of which includes a lowered portion and an elevated portion which surrounds said lowered portion, and at least one securing means forming a connection between the base member and each respective end, said connection being situated in said lowered portion.

2. A ring binder according to claim 1 wherein said elevated portion forms a a ridge member.

3. A ring binder according to claim 1 wherein the upper structure is adapted adjacent its ends to abut the base member.

4. A ring binder according to claim 2 wherein the upper structure is adapted adjacent its ends to abut the base member.

5. A ring binder according to claim 1 wherein at least part of laterally extending portions of the upper structure near the ends of the upper structure is adapted to abut the base member.

6. A ring binder according to claim 1 wherein the ring binder comprises two securing means at each respective end.

7. A ring binder adapted to be secured to a base member, which ring binder comprises:

a substantially rigid upper structure supporting a pivotable lower structure to which a plurality of ring members are mounted, the upper structure having two ends, each of which includes a lowered portion and an elevated portion which surrounds said lowered portion, and two securing means forming connections between the base member and each respective end, said connections being situated in said lowered portion and separated by a raised member.

8. A ring binder according to claim 7 wherein the upper structure further comprises at least one abutting means adapted to abut the base member.

9. A ring binder according to claim 8 wherein the abutting means further comprises at least part of the upper structure of the ring binder near said ends of the upper structure.

10. A ring binder according to claim 8 wherein the ring binder further comprises an intermediate surface between the securing means and the abutting means.

11. A ring binder according to claim 10 wherein the intermediate surface is substantially horizontal.

12. A ring binder according to claim 7 wherein the securing means is integrally formed with the upper structure.

13. A ring binder according to claim 7 wherein the securing means further comprises a plurality of engagement members integrally formed with the upper structure.

14. A ring binder adapted to be secured to a base member, the ring binder comprising a substantially rigid upper structure supporting a pivotable lower structure to which a plurality of ring members are mounted, the upper structure having two ends, each of which includes a lowered portion and an elevated portion which surrounds said lowered portion, and at least one securing means forming a connection between the base member and each respective end, said connection being situated in said lowered portion, wherein said securing means is integrally formed with the upper structure, and has a plurality of engagement members integrally formed with the upper structure, the engagement members having pointed elements pointing downward from the upper structure.

15. A ring binder according to claim 14 wherein the pointed elements depend downward from and are provided along the periphery of an aperture on the upper structure.

16. A ring binder according to claim 15 wherein the engagement members point away from the central axis of the aperture.

17. A ring binder adapted to be secured to a base member, the ring binder comprising a substantially rigid upper structure, having end portions and supporting a pivotable lower structure to which a plurality of ring members are mounted, whereby said end portions have outer edges which are directed downwards and whereby portions of said outer edges are abutting means adapted to abut the base member, the ring binder having two securing means adjacent to either end thereof, wherein the two securing means are separated by a raised member.

18. A ring binder according to claim 17 wherein the ring binder further comprises an intermediate surface between the securing means and the abutting means.

19. A ring binder according to claim 18 wherein the intermediate surface is substantially horizontal.

20. A ring binder according to claim 17 wherein the securing means further comprise a plurality of engagement members integrally formed with the upper structure.

21. A ring binder adapted to be secured to a base member, the ring binder comprising a substantially rigid upper structure supporting a pivotable lower structure to which a plurality of ring members are mounted, said upper structure having two ends, each of which includes an outer edge which is directed downwards, whereby laterally extending portions of said outer edges is adapted to abut the base member, the ring binder having at least one securing means adjacent to each of said ends, the securing means having a plurality of engagement members integrally formed with the upper structure, the engagement members having pointed elements pointing downward from the upper structure.

22. A ring binder according to claim 21 wherein the pointed elements depend downward from and are provided along the periphery of an aperture of the upper structure.

23. A ring binder according to claim 22 wherein the pointed elements point away from the central axis of the aperture.

24. A ring binder adapted to be secured to a base member, said ring binder comprising a substantially rigid upper structure supporting a pivotable lower structure to which a plurality of ring members are mounted, the upper structure having two ends, each of which includes a lowered portion and an elevated portion which surrounds said lowered portion, and said elevated portions having outer edges which are directed downward, whereby laterally extending portions of said outer edges abut the base member on both of said ends of the ring binder.

25. A ring binder adapted to be secured to a base member, said ring binder comprising a substantially rigid upper structure supporting a pivotable lower structure to which a plurality of ring members are mounted, said upper structure including two end portions, said end portions respectively having outer edges which are directed downward, wherein the outer edges at the sides and the ends of the end portions, form a continuous abutment with the base member.

* * * * *